US009865387B2

(12) United States Patent
Albers et al.

(10) Patent No.: US 9,865,387 B2
(45) Date of Patent: Jan. 9, 2018

(54) ELECTRONIC PACKAGE WITH COIL FORMED ON CORE

(71) Applicant: Intel IP Corporation, Santa Clara, CA (US)

(72) Inventors: Sven Albers, Regensburg (DE); Klaus Reingruber, Langquaid (DE); Andreas Wolter, Regensburg (DE)

(73) Assignee: Intel IP Corporation, Santa Clara, CA (US)

( * ) Notice: Subject to any disclaimer, the term of this patent is extended or adjusted under 35 U.S.C. 154(b) by 64 days.

(21) Appl. No.: 14/956,859

(22) Filed: Dec. 2, 2015

(65) Prior Publication Data

US 2017/0162314 A1 Jun. 8, 2017

(51) Int. Cl.

| | |
|---|---|
| ***H01F 5/00*** | (2006.01) |
| ***H01F 27/06*** | (2006.01) |
| ***H01F 27/28*** | (2006.01) |
| ***H01F 27/24*** | (2006.01) |

(52) U.S. Cl.
CPC ..... *H01F 27/2804* (2013.01); *H01F 27/24* (2013.01); *H01F 2027/2809* (2013.01)

(58) Field of Classification Search
CPC ..... H01F 5/00; H01F 27/28
USPC ..... 336/65, 68, 200, 232
See application file for complete search history.

(56) References Cited

U.S. PATENT DOCUMENTS 4,115,840 A 9/1978 Horton
6,087,922 A * 7/2000 Smith ..... H01F 27/2847 336/200
6,466,454 B1 * 10/2002 Jitaru ..... H01F 27/06 336/200
7,298,238 B1 * 11/2007 Eaton ..... H01F 21/12 323/255
2010/0148910 A1 * 6/2010 Takada ..... H01F 17/04 336/200
2011/0050381 A1 * 3/2011 Olson ..... H01F 17/0006 336/200
2011/0141712 A1 6/2011 You et al.
2012/0262145 A1 10/2012 Chen et al.
2013/0169403 A1 * 7/2013 Sun ..... H01F 27/324 336/200

(Continued)

OTHER PUBLICATIONS

"International Application Serial No. PCT/US2016/060254, International Search Report dated Mar. 8, 2017", 3 pgs.

(Continued)

*Primary Examiner* — Tsz Chan

(74) *Attorney, Agent, or Firm* — Schwegman Lundberg & Woessner, P.A.

(57) ABSTRACT

An electronic package that includes a substrate; a first electronic component mounted on one side of the substrate; a second electronic component mounted on an opposing side of the substrate; a core mounted to the substrate, wherein the core extends through the substrate; a first wire electrically attached to at least one of the first electronic component and the substrate, wherein the first wire is wrapped around the core to form a first coil on the one side of the substrate; and a second wire electrically attached to at least one of the second electronic component and the substrate, wherein the second wire is wrapped around the core to form a second coil on the opposing side of the substrate.

9 Claims, 6 Drawing Sheets

(56) References Cited

U.S. PATENT DOCUMENTS

| | | | |
|---|---|---|---|
| 2014/0306791 | A1 | 10/2014 | Kanazawa et al. |
| 2015/0302974 | A1 | 10/2015 | Zhao et al. |

OTHER PUBLICATIONS

"International Application Serial No. PCT/US2016/060254, Written Opinion dated Mar. 8, 2017", 9 pgs.

* cited by examiner

ELECTRONIC PACKAGE WITH COIL FORMED ON CORE

TECHNICAL FIELD

Embodiments described herein generally relate to electronic packages, and more particularly to electronic packages that includes coils.

BACKGROUND

The integration of passive components into electronic packages is commonly an important aspect in the design and fabrication of electronic devices that include passive components. As examples, transformers, transceivers, power management integrated circuits, and DC-DC converters all commonly require the integration of one or more passive components (e.g., coils).

Coils are one type of passive electronic components that is commonly used in electronic devices for impedance matching and phase-shifting for voltage transformation purposes. In addition, the coils may be used as primary or secondary coils in transformers or as part of a resonance circuit (among other applications).

Coils are typically added to electronic packages by adding them as discrete components or incorporating the coil(s) into a redistribution layer. As examples, passive electronic components are usually applied on (i) a surface of a chip; (ii) a surface of a substrate; or (iii) thin films/layers that are applied to a surface of a substrate.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Orientation terminology, such as "horizontal," as used in this application is defined with respect to a plane parallel to the conventional plane or surface of a wafer or substrate, regardless of the orientation of the wafer or substrate. The term "vertical" refers to a direction perpendicular to the horizontal as defined above. Prepositions, such as "on," "side" (as in "sidewall"), "higher," "lower," "over," and "under" are defined with respect to the conventional plane or surface being on the top surface of the wafer or substrate, regardless of the orientation of the wafer or substrate.

Figure 1:
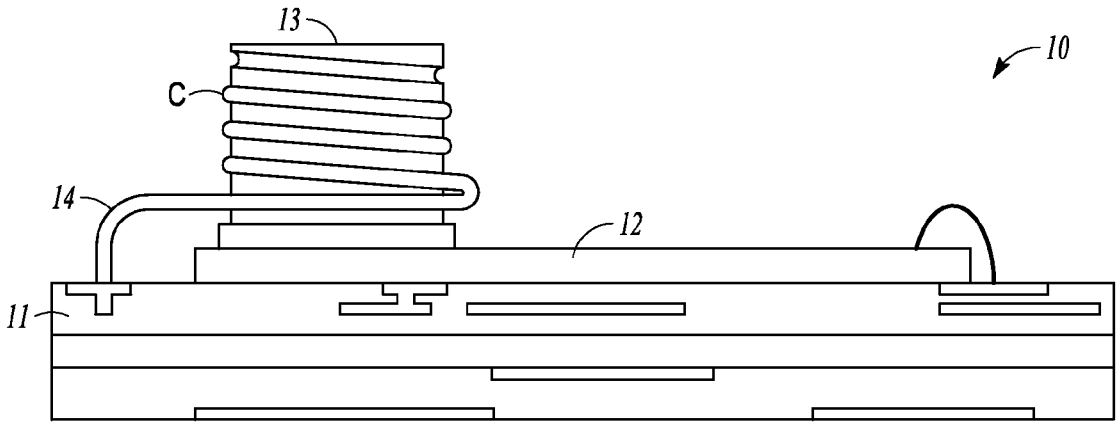
FIG. 1 shows a side view of an example electronic package that includes a core attached to a surface of an electronic component that is mounted on a substrate.

FIG. 1 is a side view of an example electronic package 10. The electronic package 10 includes a substrate 11 and an electronic component 12 (e.g., a die) mounted on the substrate 11.

A core 13 is mounted on to the electronic component 12. A wire 14 is attached to at least one of the electronic component 12 and the substrate 11. The wire 14 is wrapped around the core 13 to form a coil C. In some forms, the wire 14 may be wrapped around the core 13 using a wire bonding machine.

Figure 2:
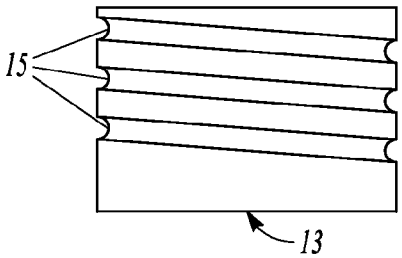
FIG. 2 shows a side view of an example core that may be used to support a coil.
Figure 3:
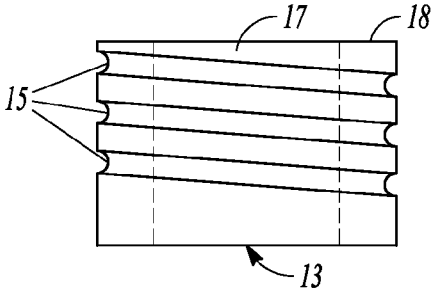
FIG. 3 shows a side view of another example core that may be used to support a coil.

FIG. 2 shows a side view of an example core 13 that may be used in the electronic package 10. FIG. 3 is a side view of another example core 13 that may be used in the electronic package 10.

As shown in FIGS. 2 and 3, the core 13 may include the external threads 15 such that the wire 14 is positioned within the external threads 15. The size of the external threads 15 will depend in part on the size of the wire 14 as well as the size of the core 13 (among other factors).

As more turns are required in a coil C, the core 13 may have a larger number of external threads 15. The number of turns that are required in the coil C will depend in part on the type of wire 14 that is used in the coil as well as the application where the electronic package 10 is to be used (among other factors).

Figure 4:
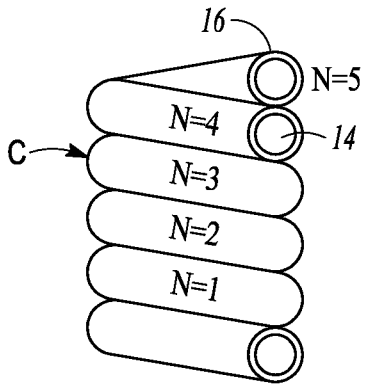
FIG. 4 shows a side view of an example coil configuration where the coil includes insulated wires.

As an example, FIG. 4 shows a wire 14 with an insulation coating 16. When an insulation coating 16 is included on the wire 14 the turns of the coil C may be placed closer together such that a greater number of turns may be included in a coil C for a given size of the core 13. In some forms, the number of turns may depend on the proficiency of a wire bonding machine that is used to form the coil C.

Figure 5:
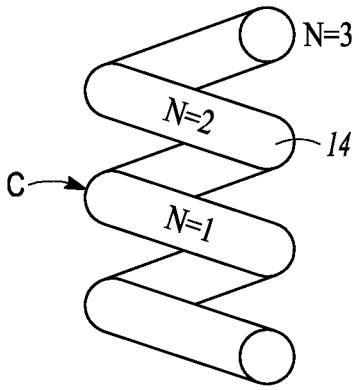
FIG. 5 shows a side view of an example coil configuration where the coil does not include insulated wires.

FIG. 5 shows an example wire 14 that does not include an insulation layer. A comparison of FIGS. 4 and 5 shows that the non-insulated wire 14 includes less turns per given length of the core in order to avoid shorting within the coil C. The example external threads 15 (shown in FIGS. 2 and 3) may guide the wire 14 during a winding process (e.g., when using a wire bonding machine) and may also serve to separate the different windings from each other in order to avoid shorting when non-insulated wires 14 are used to form the coil C.

Figure 6:
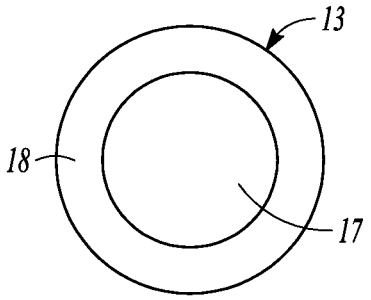
FIG. 6 shows a top view of the core shown in FIG. 3.

As shown in FIGS. 3 and 6, the core 13 may, or may not, include a ferromagnetic interior 17 that is covered by insulator 18. The types of materials that are used for the ferromagnetic interior 17 and the insulator 18 will depend in part on the (i) the type of wire 14 that is used to form the coil C; (ii) the application where the electronic package 10 is to be used; and/or (iii) manufacturing considerations that are associated with fabricating the core 13 and the electronic package 10 (among other factors).

In some forms, the core 13 may be formed entirely of an insulator or a ferromagnetic material. When the core 13 is formed with a ferromagnetic material and the wires 14 have an insulating layer 16, the core 13 may have a high magnetic permeability such that the coil C has a greater inductance and/or may promote the mutual coupling of coils that may be formed on the same core 13. It should be noted that the core 13 may include an insulator 18 (or be formed entirely of an insulating material) when the wire 14 does not include an insulating layer 16 in order to avoid shorting between the turns of the wire 14 that form the coil C.

The core 13 may be applied to the electronic component 12 in any manner that is known now, or discovered in the future (e. g, by using one or more types of adhesive). In addition, the core 13 may be mounted onto the electronic component 12 before (or after) the coil C is formed on the core 13 (e.g., when using a wire bonding machine). In some forms, the coil C may be formed on the core 13 utilizing a modified wire bonding machine that wraps the wire 14 around the core 13 (e.g., within the external threads 15) to form the coil C.

Figure 7:
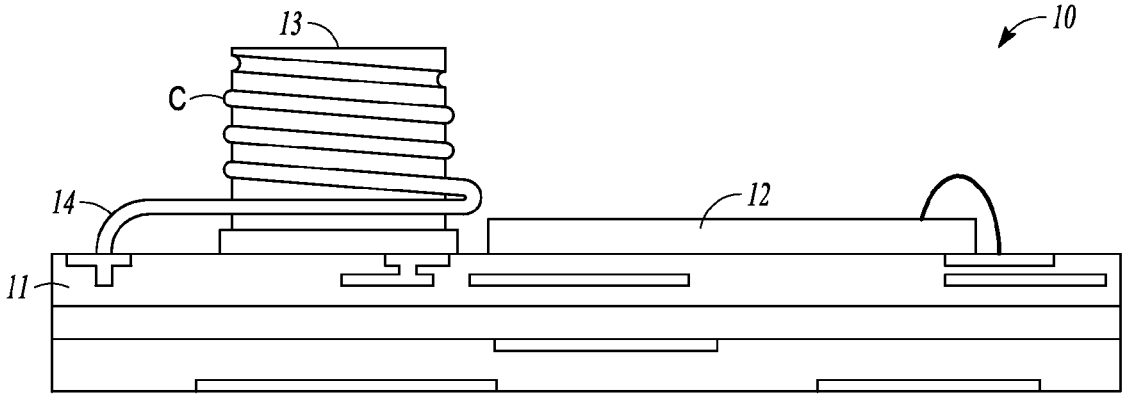
FIG. 7 shows a side view of an example electronic package that includes a core mounted on a surface of a substrate.
Figure 8:
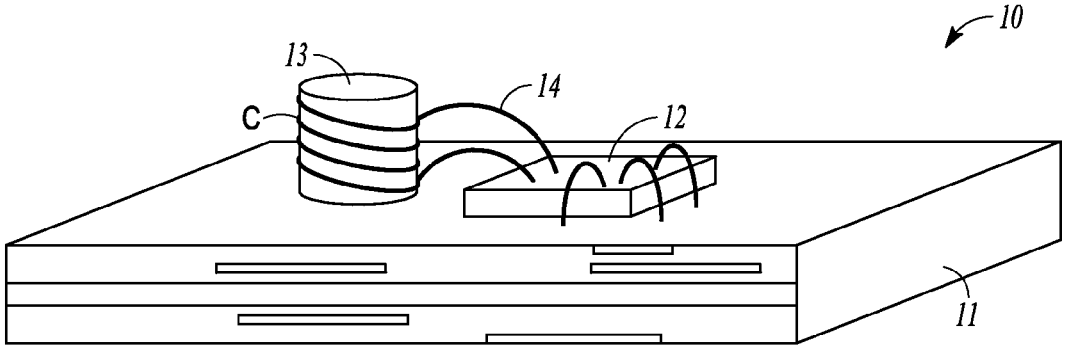
FIG. 8 shows a perspective view of the example electronic package illustrated in FIG. 7.

FIG. 7 shows another example form of the electronic package 10. In the example form illustrated in FIG. 7, the core 13 is mounted onto an upper surface of the substrate 11 instead of onto the electronic component 12. The location of the core 13 on the substrate 11 will depend in part on the size and location of the other components that form the electronic package 10 (among other factors).

Although not shown in the FIGS., the electronic package 10 may further include an additional core that is mounted on the electronic component 12 and an additional wire that is electrically connected to at least one of the electronic component 12 and the substrate 11. The additional wire is wrapped around the additional core to form an additional coil. As an example, the additional coil may be formed on the core using wire bonding techniques. The number, type and arrangement of additional cores and coils will depend in part on the overall configuration of the electronic package 10 as well as the application where the electronic package 10 is to be used (among other factors).

Figure 9:
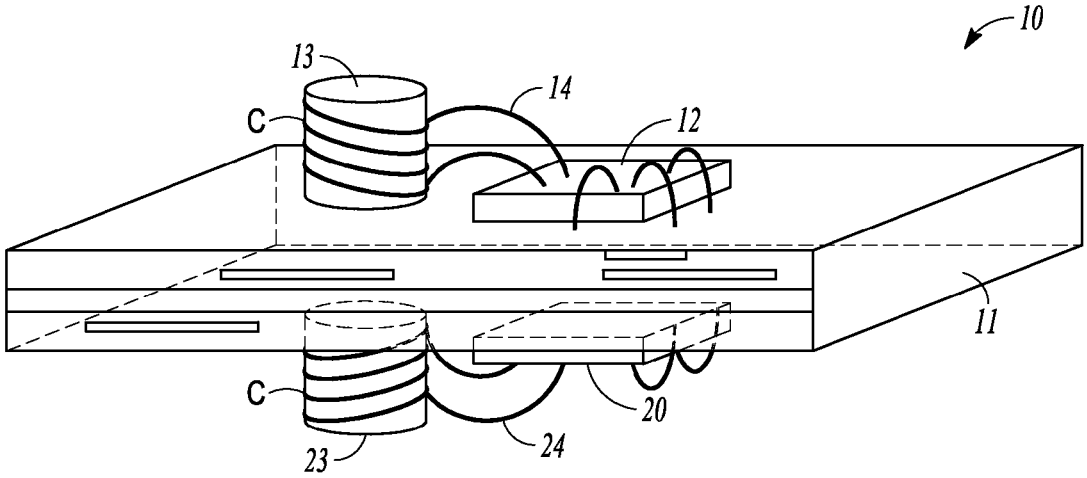
FIG. 9 shows a perspective view of an example electronic package that includes a coil attached to one side of a substrate and another coil attached to an opposing side of the substrate.

As shown in FIG. 9, the electronic component 12 may be a first electronic component 12, and the electronic package 10 may further include a second electronic component 20 that is mounted on an opposing side of the substrate 11 to the first electronic component 12. The electronic package 10 may further include an additional core 23 that is mounted on the second electronic component 20 and an additional wire 24 that is electrically attached to at least one of the second electronic component 20 and the substrate 11. The additional wire 24 is wrapped around the additional core 23 to form an additional coil C (e.g., using a wire bonding machine).

Figure 10:
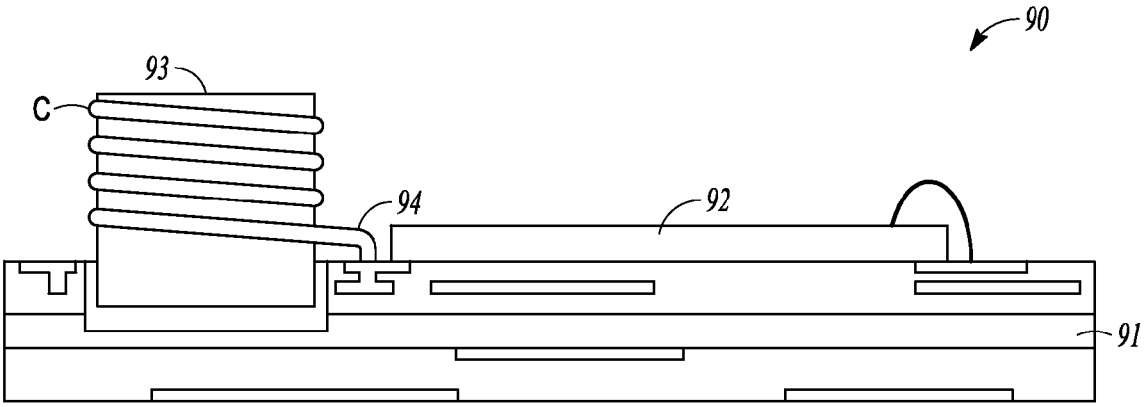
FIG. 10 shows a side view of an example electronic package that includes a core partially embedded within a substrate.

FIG. 10 shows a side view of another example electronic package 90. The electronic package 90 includes a substrate 91 and an electronic component 92 mounted on the substrate 91.

A core 93 is partially embedded in a substrate 91. A wire 94 is electrically attached to at least one of the electronic component 92 and the substrate 91. The wire 94 is wrapped around the core 93 to form a coil C. In some forms, the wire 94 may be wrapped around the core 93 using a wire bonding machine.

It should be noted that the core 93 may be similar to any of the cores 13 described herein. In addition, the wire 94 may be similar to any of the wires 14 described herein.

One potential benefit of having the core 93 partially embedded into the substrate 91 is that there may be increased coupling between a coil C that is built on the core 93 and coils (e.g., two-dimensional coils) that are within the substrate 91 (two-dimensional coils are not shown in the FIGS.).

In some forms, the electronic package 90 may further include an additional core (not shown) that is partially embedded in the substrate 91 and an additional wire that is electrically attached to at least one of the electronic component 92 and the substrate 91. The additional wire (not shown) may be wrapped around the additional coil to form an additional coil (e.g., using a wire bonding machine).

Other forms of the electronic package 90 are contemplated where the electronic component 92 is a first electronic component 92 and the electronic package 90 further includes an additional core (not shown) that is partially embedded in the opposing side of the substrate 91. The electronic package 90 may further include an additional wire (not shown) that is electrically attached to the substrate 91 and/or the electronic component 92 (shown attached to substrate 91 in FIG. 10). The additional wire may be wrapped around the additional core to form an additional coil (e.g., using a wire bonding machine).

It should be noted that the number of cores and corresponding coils as well as the location of the cores and coils on one, or both sides, of the substrate 91 will depend in part on manufacturing considerations as well as the application where the electronic package 90 is to be used (among other factors). In addition, forms of the electronic package 90 are contemplated where the electronic package 90 includes none, one, or a plurality of electronic components mounted on one, or both, sides of the substrate 91. The number and types of coils may also depend on the proficiency of a wire bonding machine that is used apply one (or more) of the coils.

Figure 11:
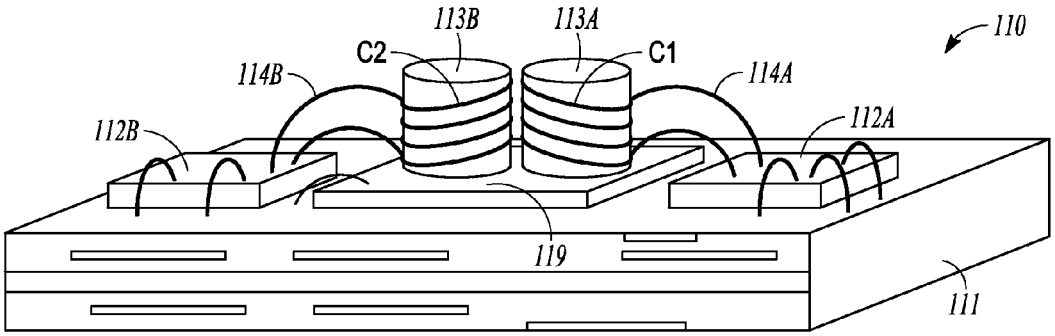
FIG. 11 shows a perspective view of an example electronic package that includes a plurality of cores mounted on one side of a substrate.

FIG. 11 shows another example electronic package 110. The electronic package 110 includes a substrate 111 and a first electronic component 112A mounted on one side of the substrate 111. The electronic package 110 further includes a second electronic component 112B mounted on the same side of the substrate 111.

The electronic package 110 further includes a first core 113A that is mounted to the substrate 111 and a second core 113B that is mounted to the substrate 111. A first wire 114A is electrically attached to at least one of the first electronic component 112A and the substrate 111. The first wire 114A is wrapped around the core 113A to form a first coil C1 on the substrate 111. In some forms, the wire 114A may be wrapped around the core 113A using a wire bonding machine.

A second wire 114B is electrically attached to at least one of the second electronic component 112B and the substrate 111. The second wire 114B is wrapped around the core 113B to form a second coil C2 on the substrate 111. In some forms, the wire 114B may be wrapped around the core 113B using the same wire bonding machine or a different wire bonding machine.

It should be noted that the first and second cores 113A, 113B may be mounted directly to the substrate or may be formed as part of the same item (see, e.g., base plate 119 shown in FIG. 11) that is then mounted to the substrate 111. In addition, the first and second cores 113A, 113B and the base plate 119 may be the same (or different) materials (e.g., ferromagnetic materials for magnetic coupling).

Figure 12:
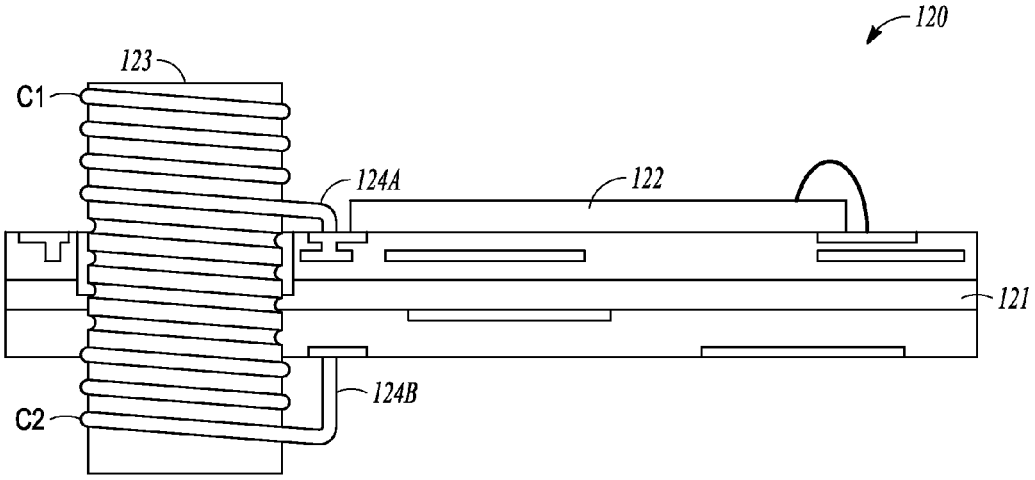
FIG. 12 shows a side view of an example electronic package that includes a core extending through a substrate.

FIG. 12 is a side view of another example electronic package 120. The electronic package 120 includes a substrate 121 and a first electronic component 122 mounted on one side of substrate 121. In some forms, the electronic package 120 may further include a second electronic component (not shown in FIG. 12) that is mounted on an opposing side of the substrate 121.

A core 123 is mounted to the substrate 121. The core 123 extends through the substrate 121.

A first wire 124A is electrically attached to at least one of the first electronic component 122 and the substrate 121. The first wire 124A is wrapped around the core 123 to form a first coil C1 on one side of the substrate 121. In some forms, the first wire 124A may be wrapped around the core 123 using a wire bonding machine.

A second wire 124B is electrically attached to at least one of the second electronic component (not shown in FIG. 12) and the substrate 121. The second wire 124B is wrapped around the core 123 to form a second coil C2 on an opposing side of the substrate 121. In some forms, the wire 124B may be wrapped around the core 123 using a wire bonding machine.

It should be noted that core 123 may be similar to any of the cores 13, 93 that are described herein. In addition, the first and second wires 124A, 124B may be similar to any of the wires 14, 94 that are described herein. As discussed above, the number, type and location of any electronic components that are included in the electronic package 112 will depend in part on the manufacturing considerations as well as the application where the electronic package 120 is to be used (among other factors).

It should be noted that any of the wires described herein that form coils may be attached at one, or both, ends of the wire to a substrate and/or an electronic component depending on the application where the electronic package is to be used (among other factors). In addition, more than one wire may be wrapped around a core such that multiple coils are formed on one, some, or all of the cores (e.g., by using a wire bonding machine).

The electronic packages 10, 90, 110, 120 described herein may permit an increase in the number of electronic components that are within an electronic package of a particular size. Mounting the cores to the substrate and/or the electronic component may permit for an increase in the number of components on a particular size electronic package or even permit a reduction in the size of an electronic package. The coils and cores described herein may increase the overall performance of the electronic package by reducing parasitic resistance, capacitance and/or inductance within the electronic package due to a decreased connection length from the substrate and/or chip to the coil(s) on the cores.

The electronic systems that described herein include coils that are created by using a wire bonding process to wrap wire around a core material. In some forms, vertical coils may be located on a front and/or backside of a PCB, substrate or a semiconductor device.

Electronic packages are contemplated where a core (i) is located on one side of an electronic component or a PCB/substrate; (ii) penetrates partially into the PCB/substrate; and/or (iii) extends through the PCB/substrate. The coils may be connected onto wire bond pads on redistribution/substrate/metal layers and may utilize unused portions of electronic packages.

Figure 13:
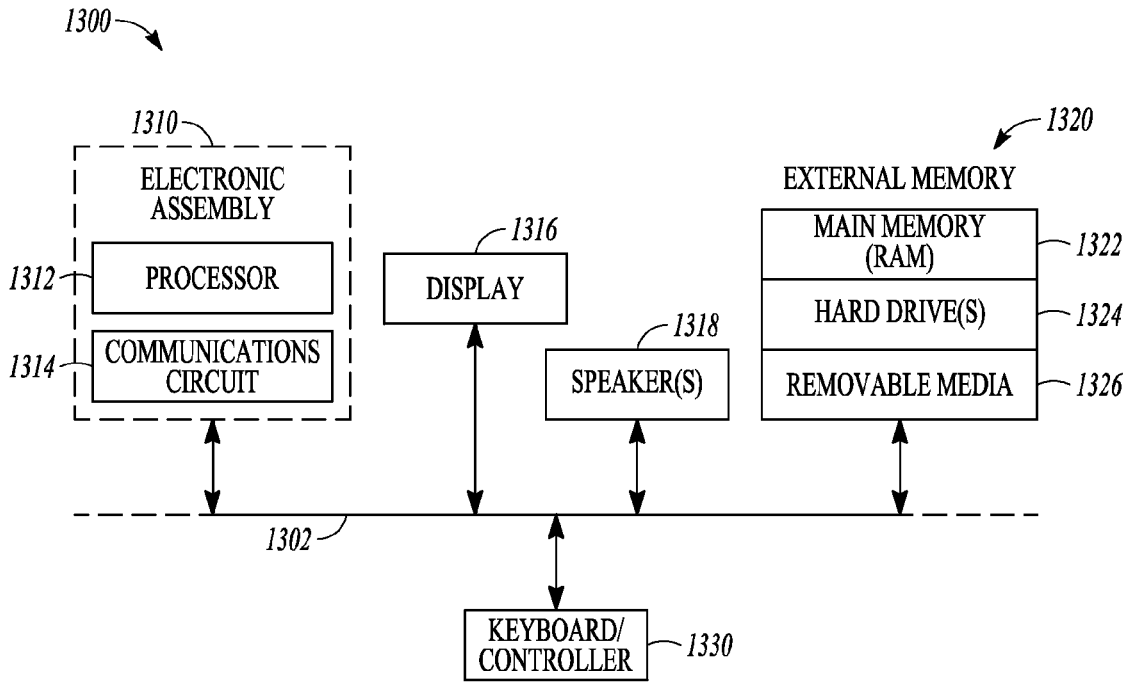
FIG. 13 is a block diagram of an electronic apparatus that includes the electronic packages described herein.

FIG. 13 is a block diagram of an electronic apparatus 1300 incorporating at least one electronic package described herein. Electronic apparatus 1300 is merely one example of an electronic apparatus in which forms of the electronic package(s) may be used.

Examples of an electronic apparatus 1300 include, but are not limited to, personal computers, tablet computers, mobile telephones, wearables, drones, game devices, MP3 or other digital music players, etc. In this example, electronic apparatus 1300 comprises a data processing system that includes a system bus 1302 to couple the various components of the electronic apparatus 1300. System bus 1302 provides communications links among the various components of the electronic apparatus 1300 and may be implemented as a single bus, as a combination of busses, or in any other suitable manner.

An electronic assembly 1310 that includes any of the electronic package(s) described herein may be coupled to (or form part of) system bus 1302. The electronic assembly 1310 may include any circuit or combination of circuits. In one embodiment, the electronic assembly 1310 includes a processor 1312 which can be of any type. As used herein, "processor" means any type of computational circuit, such as but not limited to a microprocessor, a microcontroller, a complex instruction set computing (CISC) microprocessor, a reduced instruction set computing (RISC) microprocessor, a very long instruction word (VLIW) microprocessor, a graphics processor, a digital signal processor (DSP), multiple core processor, or any other type of processor or processing circuit.

Other types of circuits that may be included in electronic assembly 1310 are a custom circuit, an application-specific integrated circuit (ASIC), or the like, such as, for example, one or more circuits (such as a communications circuit 1314) for use in wireless devices like mobile telephones, tablet computers, laptop computers, two-way radios, and similar electronic systems. The IC can perform any other type of function.

The electronic apparatus 1300 may also include an external memory 1320, which in turn may include one or more memory elements suitable to the particular application, such as a main memory 1322 in the form of random access memory (RAM), one or more hard drives 1324, and/or one or more drives that handle removable media 1326 such as compact disks (CD), flash memory cards, digital video disk (DVD), and the like.

The electronic apparatus 1300 may also include a display device 1316, one or more speakers 1318, and a keyboard and/or controller 1330, which can include a mouse, trackball, touch screen, voice-recognition device, or any other device that permits a system user to input information into and receive information from the electronic apparatus 1300.

This overview is intended to provide non-limiting examples of the present subject matter—it is not intended to provide an exclusive or exhaustive explanation. The detailed description is included to provide further information about the methods.

To better illustrate the method and apparatuses disclosed herein, a non-limiting list of embodiments is provided here:

Example 1 includes an electronic package. The electronic package includes a substrate; an electrical component mounted on the substrate; a core mounted onto the electronic component; and a wire electrically attached to at least one of the electronic component and the substrate, wherein the wire is wrapped around the core to form a coil.

Example 2 includes the electronic package of claim 1, wherein the core includes external threads and the wire is positioned within the external threads.

Example 3 includes the electronic package of any one of examples 1 to 2, wherein the wire has an insulation coating.

Example 4 includes the electronic package of any one of examples 1 to 3, wherein the core includes a ferromagnetic interior that is covered by an insulator.

Example 5 includes the electronic package of any one of examples 1 to 4, and further including an additional core mounted on the electronic component; and an additional wire electrically attached to at least one of the electronic component and the substrate, wherein the additional wire is wrapped around the additional core to form an additional coil.

Example 6 includes the electronic package of any one of examples 1 to 5, wherein the electronic component is a first electronic component, and further including a second electronic component mounted on an opposing side of the substrate to the first electronic component; an additional core mounted on the second electronic component; and an additional wire electrically attached to at least one of the second electronic component and the substrate, wherein the additional wire is wrapped around the additional core to form an additional coil.

Example 7 includes the electronic package of any one of examples 1 to 6, wherein the electronic component is a die.

Example 8 includes an electronic package. The electronic package includes a substrate; an electrical component mounted on the substrate; a core partially embedded in the substrate; and a wire electrically attached to at least one of the electronic component and the substrate, wherein the wire is wrapped around the core to form a coil.

Example 9 includes the electronic package of example 8, wherein core includes external threads and the wire is positioned within the external threads.

Example 10 includes the electronic package of any one of examples 8 to 9, wherein the wire has an insulation coating.

Example 11 includes the electronic package of any one of examples 8 to 10, wherein the core includes a ferromagnetic interior that is covered by an insulator.

Example 12 includes the electronic package of any one of examples 8 to 11, and further including an additional core partially embedded in the substrate, wherein the core and the additional core are on a same side of the substrate; and an additional wire electrically attached to at least one of the electronic component and the substrate, wherein the additional wire is wrapped around the additional core to form an additional coil.

Example 13 includes electronic package of any one of examples 8 to 12, wherein the electronic component is a first electronic component, and further including an additional core partially embedded in an opposing side of the substrate; and an additional wire electrically attached to at least one of the second electronic component and the substrate, wherein the additional wire is wrapped around the additional core to form an additional coil.

Example 14 includes the electronic package of any one of examples 8 to 13, and further including a second electronic component mounted on the opposing side of the substrate to the first electronic component.

Example 15 includes the electronic package of any one of examples 8 to 14, wherein at least one of the first electronic component and the second electronic component is a die.

Example 16 includes an electronic package. The electronic package includes a substrate; a first electronic component mounted on one side of the substrate; a second electronic component mounted on an opposing side of the substrate; a core mounted to the substrate, wherein the core extends through the substrate; a first wire electrically attached to at least one of the first electronic component and the substrate, wherein the first wire is wrapped around the core to form a first coil on the one side of the substrate; and a second wire electrically attached to at least one of the second electronic component and the substrate, wherein the second wire is wrapped around the core to form a second coil on the opposing side of the substrate.

Example 17 includes the electronic package of example 16, wherein the core includes external threads, and wherein the first wire is positioned within the external threads on the one side of the substrate and the second wire is positioned within the external threads on the opposing side of the substrate.

Example 18 includes the electronic package of any one of examples 16 to 17, wherein the first wire has an insulation coating and the second wire has an insulation coating.

Example 19 includes the electronic package of any one of examples 16 to 18, wherein the core includes a ferromagnetic interior that is covered by an insulator.

Example 20 includes the electronic package of any one of examples 16 to 19, wherein the first and second electronic components are different types of electronic components.

These and other examples and features of the present electronic device, solder compositions, and related methods will be set forth in part in the detailed description. This overview is intended to provide non-limiting examples of the present subject matter—it is not intended to provide an exclusive or exhaustive explanation. The detailed description is included to provide further information about the systems, and methods.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. An electronic package, comprising:

a substrate;

a first electronic component mounted on one side of the substrate;

a second electronic component mounted on an opposing side of the substrate;

a core mounted to the substrate, wherein the core extends through the substrate;

a first wire electrically attached to at least one of the first electronic component and the substrate, wherein the first wire is wrapped around the core to form a first coil on the one side of the substrate; and a second wire electrically attached to at least one of the second electronic component and the substrate, wherein the second wire is wrapped around the core to form a second coil on the opposing side of the substrate, wherein the core includes external threads, and wherein the first wire is positioned within the external threads on the one side of the substrate and the second wire is positioned within the external threads on the opposing side of the substrate.

2. The electronic package of claim 1, wherein the first wire has an insulation coating and the second wire has an insulation coating.

3. The electronic package of claim 1, wherein the core includes a ferromagnetic interior that is covered by an insulator.

4. The electronic package of claim 1, wherein the first and second electronic components are different types of electronic components.

5. The electronic package of claim 1, wherein the first electronic component is a die.

6. An electronic package, comprising:

a substrate;

a first electronic component mounted on one side of the substrate;

a second electronic component mounted on an opposing side of the substrate;

a core mounted to the substrate, wherein the core extends through the substrate;

a first wire electrically attached to at least one of the first electronic component and the substrate, wherein the first wire is wrapped around the core to form a first coil on the one side of the substrate; and a second wire electrically attached to at least one of the second electronic component and the substrate, wherein the second wire is wrapped around the core to form a second coil on the opposing side of the substrate, and wherein the first wire is directly attached to an upper surface of the substrate and the second wire is directly attached to a lower surface of the substrate.

7. The electronic package of claim 6, wherein the first wire is exposed such the first wire is not embedded in any other portion of the electronic package and the second wire is exposed such the second wire is not embedded in any other portion of the electronic package.

8. The electronic package of claim 6, wherein the core includes external threads and the first wire and the second wire are positioned within the external threads.

9. The electronic package of claim 6, wherein the first electronic component is a die.

* * * * *